US009523260B2

(12) United States Patent
Mailand et al.

(10) Patent No.: US 9,523,260 B2
(45) Date of Patent: Dec. 20, 2016

(54) DUAL BARRIER INJECTION VALVE

(71) Applicant: Tejas Research & Engineering LLC, The Woodlands, TX (US)

(72) Inventors: Jason Charles Mailand, The Woodlands, TX (US); Thomas G. Hill, Jr., Conroe, TX (US)

(73) Assignee: Tejas Research & Engineering, LLC, The Woodlands, TX (US)

( * ) Notice: Subject to any disclaimer, the term of this patent is extended or adjusted under 35 U.S.C. 154(b) by 0 days.

(21) Appl. No.: 14/697,289

(22) Filed: Apr. 27, 2015

(65) Prior Publication Data

US 2015/0361763 A1 Dec. 17, 2015

Related U.S. Application Data

(63) Continuation-in-part of application No. 13/863,063, filed on Apr. 15, 2013, now Pat. No. 9,217,312, which is a continuation-in-part of application No. 13/669,059, filed on Nov. 5, 2012, now Pat. No. 9,334,709.

(60) Provisional application No. 61/639,569, filed on Apr. 27, 2012.

(51) Int. Cl.

| | |
|---|---|
| ***E21B 34/14*** | (2006.01) |
| ***E21B 34/10*** | (2006.01) |
| ***E21B 41/00*** | (2006.01) |
| *E21B 34/00* | (2006.01) |

(52) U.S. Cl.

CPC ..... *E21B 34/10* (2013.01); *E21B 34/102* (2013.01); *E21B 34/14* (2013.01); *E21B 41/0078* (2013.01); *E21B 2034/005* (2013.01)

(58) Field of Classification Search

CPC .... E21B 34/10; E21B 34/12; E21B 34/00521; E21B 34/005; E21B 34/106

See application file for complete search history.

(56) References Cited

U.S. PATENT DOCUMENTS

| | | | |
|---|---|---|---|
| 3,973,587 | A | 8/1976 | Cochran |
| 4,069,871 | A | 1/1978 | Page, Jr. |
| 4,137,933 | A | 2/1979 | Culpepper |
| 4,416,301 | A | 11/1983 | Brumm |
| 4,585,067 | A | 4/1986 | Blizzard et al. |
| 4,601,342 | A | 7/1986 | Pringle |
| 4,624,315 | A | 11/1986 | Dickson et al. |
| 5,004,007 | A | 4/1991 | Johnson et al. |
| 5,095,994 | A | 3/1992 | Dollison |
| 5,190,106 | A | 3/1993 | Johnston |
| 6,415,509 | B1 | 7/2002 | Echols et al. |

(Continued)

OTHER PUBLICATIONS

Final Office Action for U.S. Appl. No. 13/863,063 dated Jun. 11, 2015.

(Continued)

*Primary Examiner* — Michael Wills, III
(74) *Attorney, Agent, or Firm* — Tumey L.L.P.

(57) ABSTRACT

A wireline retrievable injection valve for an oil or gas well has an internal valve that is initially moved to open a flapper safety valve and also opens to allow fluid flow through the valve. The internal valve includes a sleeve that opens the flapper safety valve and shields the flapper safety valve from fluid. In this manner the flapper valve is protected from being caused to "flutter" or "chatter" due to pressure variations in the fluid flow, which may damage the seat.

13 Claims, 18 Drawing Sheets

(56) References Cited

U.S. PATENT DOCUMENTS

| | | | | |
|---|---|---|---|---|
| 6,514,408 | B1 | 2/2003 | Simone | |
| 6,799,686 | B2 | 10/2004 | Echols et al. | |
| 6,971,405 | B2 | 12/2005 | Pickelman | |
| 7,287,684 | B2 | 10/2007 | Blackburne, Jr. | |
| 7,578,344 | B2 | 8/2009 | Hopkins et al. | |
| 7,614,452 | B2 | 11/2009 | Kenison et al. | |
| 7,703,532 | B2 | 4/2010 | O'Malley et al. | |
| 7,814,982 | B2 | 10/2010 | Moyes | |
| 7,866,401 | B2 | 1/2011 | McCalvin | |
| 8,365,753 | B2 | 2/2013 | Dana | |
| 2006/0278395 | A1 | 12/2006 | Kenison et al. | |
| 2007/0256834 | A1 | 11/2007 | Hopkins et al. | |
| 2008/0236842 | A1 | 10/2008 | Bhavsar et al. | |
| 2009/0065215 | A1 | 3/2009 | Tveiten et al. | |
| 2012/0312540 | A1* | 12/2012 | Lefebvre | E21B 34/08 166/319 |

OTHER PUBLICATIONS

Office Action for U.S. Appl. No. 13/863,063 dated Apr. 8, 2015.

EPO Search Report for Application No. 13781010.7 dated Nov. 17, 2015.

Notice of Allowance for U.S. Appl. No. 13/863,063 dated Aug. 14, 2015.

International Search Report and Written Opinion for Application No. PCT/US2013/038438 dated Aug. 16, 2013.

USPTO Final Office Action for U.S. Appl. No. 13/669,059 dated Oct. 14, 2015.

USPTO Notice of Allowance for U.S. Appl. No. 13/669,059 dated Jan. 8, 2016.

USPTO Office Action for U.S. Appl. No. 13/863,063 dated Apr. 8, 2015.

Schlumberger publication "TRTO Series Injection Safety Valves"; pp. 1-2; copyright 2009.

Schlumberger publication "A-Series Injection Valves"; p. 1-2; copyright 2009.

USPTO Office Action for U.S. Appl. No. 13/669,059 dated Apr. 16, 2015.

USPTO Final Office Action for U.S. Appl. No. 13/863,063 dated Jun. 11, 2015.

* cited by examiner

DUAL BARRIER INJECTION VALVE

This application is a continuation-in-part of a U.S. application Ser. No. 13/863,063 filed on Apr. 15, 2013, which is a continuation-in-part of U.S. application Ser. No. 13/669,059 filed on Nov. 5, 2012 which claims priority to provisional application Ser. No. 61/639,569 with a filing date of Apr. 27, 2012.

BACKGROUND OF INVENTION

1. Field of the Invention

This invention is directed to an injection valve typically used in conjunction with an injection well. Injection wells are drilled for example in close proximity to hydrocarbon producing wells that have peaked in terms of their output. Fluid for example water is pumped under pressure into an injection well to maintain the pressure of the underlying formation as the well is produced. Injected water acts to force the hydrocarbons into adjacent producing wells thus increasing the yield.

2. Description of Related Art

U.S. Pat. No. 7,866,401 discloses an injection safety valve having a restrictor, also known as an orifice, create a pressure differential so as to move a flow tube past a flapper valve. The diameter of the restrictor is fixed.

A problem with injection valves is a phenomenon known to those of normal skill in the art as "chattering". Chattering occurs when the injection rate is insufficient to allow the valve to fully open, whereby the flow across the fixed orifice (the standard in injection valves) is too low to compress the power spring and shift the flow tube into a position to hold the flapper into the fully open and protected position.

Chattering causes the flapper to intermittently and rapidly slam into the flapper seat causing premature failure of either the flapper and/or seat. Such failure can cause an unsafe well condition necessitating premature, immediate shut in of the well, and expensive well remediation,—sometimes costing tens of millions of dollars in the instance of subsea wells.

BRIEF SUMMARY OF THE INVENTION

One embodiment of the invention includes providing a tubing retrievable injection valve having a full bore internal diameter when running and retrieving the valve. A "slickline" or "wireline" retrievable "nozzle assembly" having an orifice is carried by and affixed in the wellbore by a lock assembly. The nozzle assembly is retrievable without removing the injection valve. Consequently the diameter of the nozzle may be changed on the surface. The injection valve also has a temporary lock out feature so that the valve may be placed in the well in a lock out mode. In certain situations where the flow rate of the water may vary, an embodiment of the invention includes a nozzle assembly with a variable orifice to provide an infinitely variable downhole nozzle. The nozzle is designed to generate a pressure drop sufficient to hold the flapper valve fully open. This prevents the flapper valve from "chattering" and isolates the flapper valve from fluid flow during injection both of which are harmful to the flapper valve assembly.

Additionally, in yet further embodiment of the invention, a pair of opposite pole magnets are provided. One magnet is attached to an upper sleeve of the nozzle assembly and a second magnet is attached to a middle sleeve member which carriers a variable orifice. In the run-in position, the flapper valve is locked out and the variable orifice insert permits flow of liquid in both directions. In the set position within the well, the upper sleeve and middle sleeve are locked together and injection into the well is permitted. Once the flowrate is decreased at the surface, the variable orifice insert resets into the fully closed position while a return spring returns the flow tube to the initial position allowing the flapper to close. Once injection resumes, the differential pressure across the variable orifice insert is very high because it's held in a closed position by the strong magnets. Hence the variable orifice insert moves to a position which opens the flapper valve before any flow is established through the injection valve. In this manner, no flapper chattering is possible. As the injection flow rate is increased, the variable orifice insert will open a greater area in response to the flow rate to allow more flow to pass through the internal restriction. As the restriction is opened by flow, the magnet force is decreased allowing very low operational differential pressure during operation. The operating differential pressure must be above the opening differential pressure for the flow tube and flapper valve to stay open during injection. When the injection flowrate is decreased, the flapper will close thus protecting the valve surface from produced injection water.

The variable output nozzles are designed so that as flow occurs, the flow tube will first move in a direction to open the flapper valve and then the output area of the nozzle will increase with increased flow rates.

The nozzle assembly can either be run pre-installed in the injection valve prior to running or after the injection valve has been set, utilizing wireline/slickline operations to insert and or remove the nozzle assembly from the injection valve.

A further embodiment of the invention is directed to a wireline retrievable injection valve that includes a flapper valve at one end and an axially movable sleeve within which is mounted to a second valve. The second valve is pressure responsive and includes a variable orifice.

According to another embodiment of the invention, the valve may be designed as a flapperless injection valve thus simplifying the design and construction of the valve.

BRIEF DESCRIPTION OF THE SEVERAL VIEWS OF THE DRAWING(S)

DETAILED DESCRIPTION OF THE INVENTION

Figure 1:
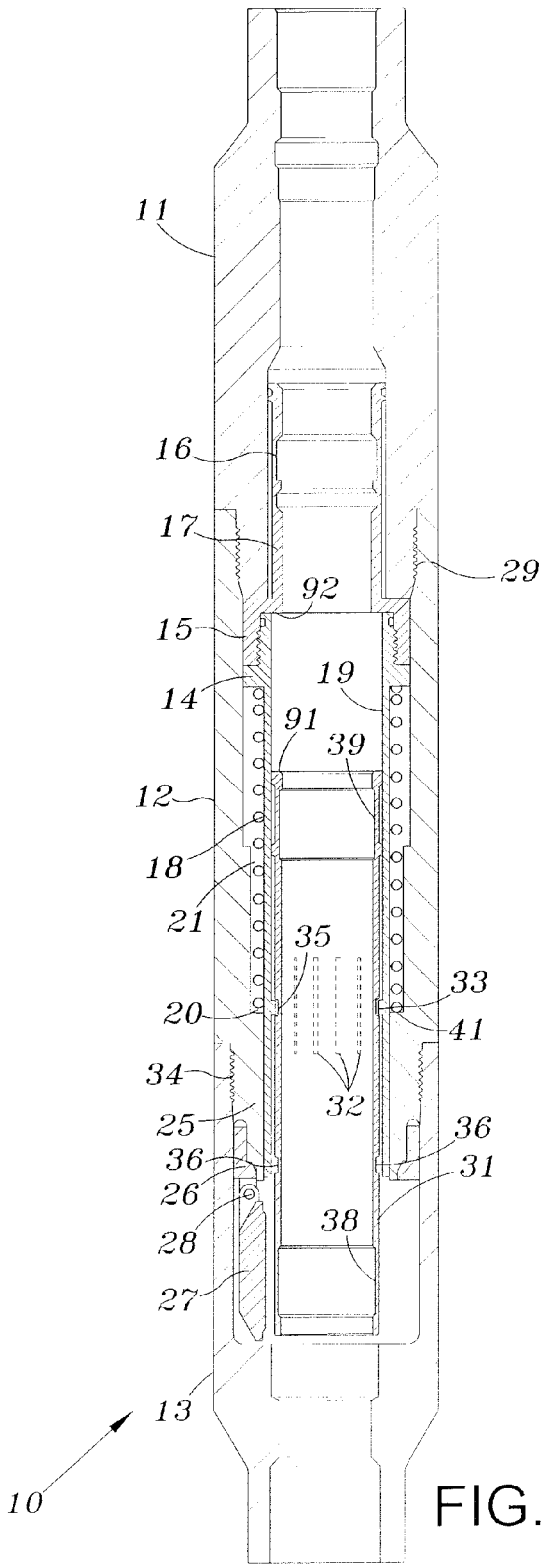
FIG. 1 is a cross sectional view of an embodiment of the valve in a lock out, running position.

Referring to FIG. 1, an embodiment of the injection valve 10 includes a pressure containing body comprising an upper valve body member 11, a tubular middle valve body member 12 suitably attached to the upper valve body member 11 by threads at 29, for example, and a lower valve body member 13 which is connectable to a tubular at its downhole end. Valve body members 12 and 13 are secured to each other by threads for example at 34.

The injection valve 10 further includes an upper flow tube having a first section 17 and a second section 14 which are secured together. Section 17 has an interior nipple profile at 16 for receiving a tool. Section 14 has an elongated sleeve portion 19 that extends to valve seat 26 when the valve is in the position shown in FIG. 1. Elongated sleeve portion 19 includes a plurality of slots 32 as shown in FIG. 1. Ridges 33 are formed on the inner surface of sleeve 19 around slots 32 thus forming a collet. A shiftable lower flow tube 31 is positioned within the elongated sleeve portion 19 of the upper flow tube. Shiftable lower flow tube 31 has two annular grooves 35 and 36 on its outer periphery located so as to form a profile for engagement with ridges 33 on the inner surface of elongated sleeve portion 19. Shiftable flow tube 31 also has shifting profiles 39 and 38 at each end thereof.

Middle body member 12 has a reduced diameter portion 25 that carries an annular valve seat 26. A flapper valve 27 is pivotably connected at 28 to valve seat 26 and is resiliently biased to a closed position on valve seat 26 as is known in the art.

A coil spring 18 is positioned about elongated sleeve portion 19 and is captured between shoulder 14 of the upper flow tube and an internal shoulder 41 provided within middle valve body member 12.

In the temporary lock out running position shown in FIG. 1, shiftable flow tube 31 is positioned within the valve body so as to extend beyond valve seat 26 thereby maintaining flapper valve 27 in an open position.

Figure 2:
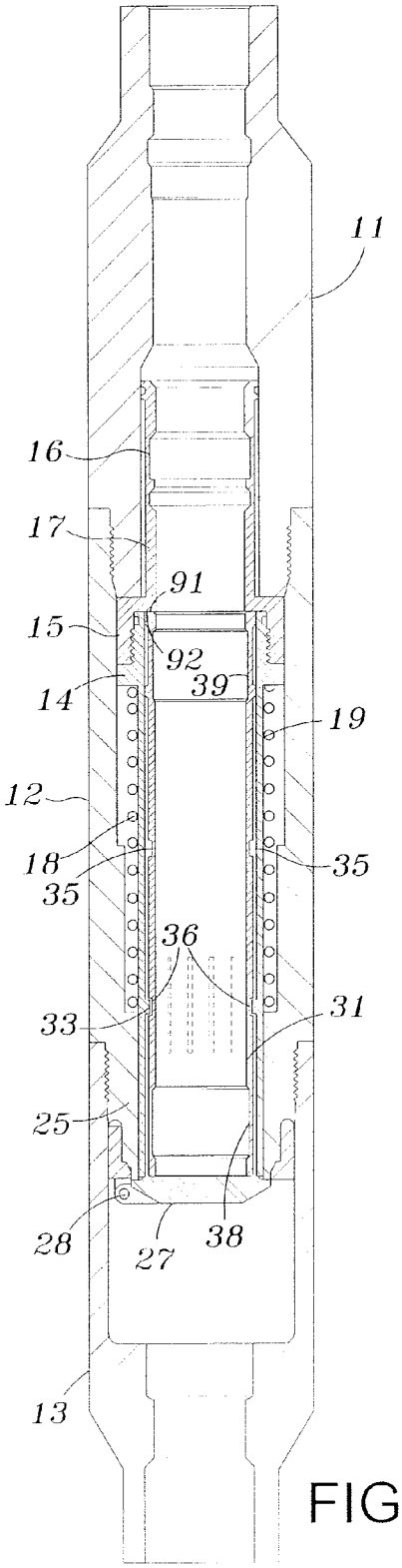
FIG. 2 is a cross sectional view of an embodiment of the valve in a pre-injection position with the valve member closed.

When the valve is positioned within the well at the desired location, a suitable running tool is lowered into the well and engages the upper shifting, profile 39 of shiftable flow tube 31 and the flow tube is moved upwardly, to the position shown in FIG. 2. The uphole end portion 91 of the shiftable lower flow tube 31 will abut a shoulder portion 92 of the upper flow tube 15 as shown in FIG. 2. In this position, the resiliently biased flapper valve will be in the closed position.

The retrievable nozzle selective lock assembly (RNSLA) will now be discussed with reference to FIGS. 3 and 4. The RNSLA 50 includes a sleeve formed by generally cylindrical members 51, 52, 56 and, 53 having an interior flow passage 61. An inner tubular member 56 is located within cylindrical member 52 and carries nozzle 53. A plurality of selective locking dogs 58 are located around a portion of its periphery as shown in FIG. 4. Leaf springs 59 are positioned under locking dogs 58. RNSLA 50 includes an annular packing assembly 55. A replaceable and retrievable orifice nozzle 53 is releaseably attached to the body portion of the RNSLA and includes an orifice 54. Nozzle 53 may be replaced on the surface with another nozzle having a different size orifice 54.

Figure 5:
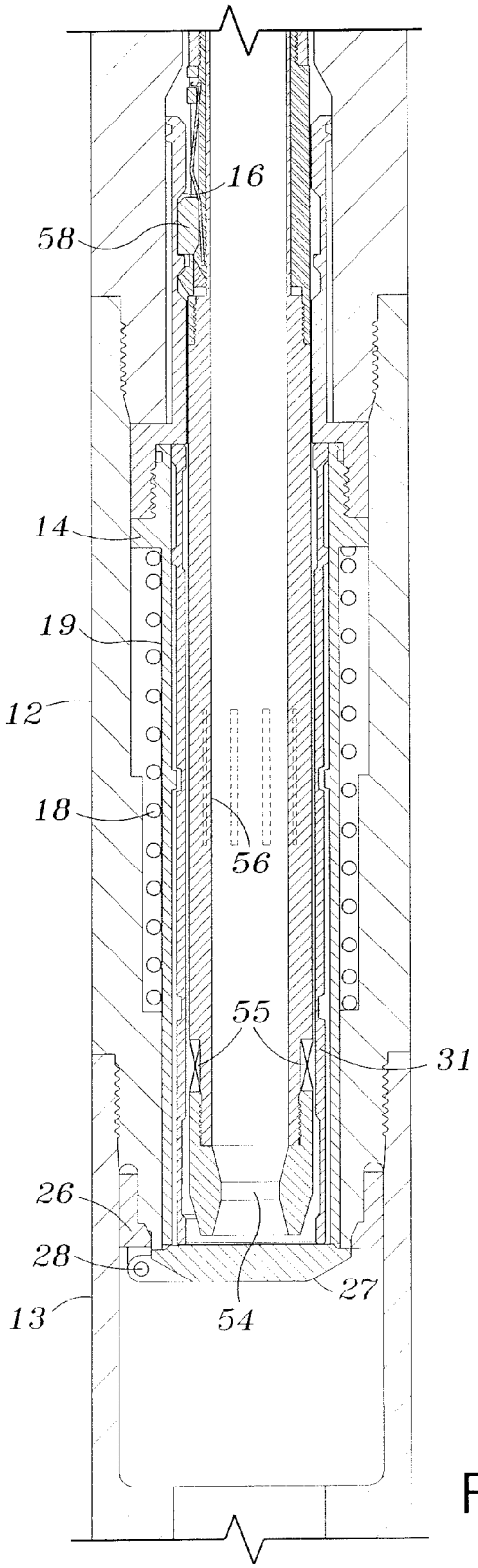
FIG. 5 is a cross sectional view of a valve showing the retrievable nozzle selective lock assembly located within the valve body.

FIG. 5 illustrates the position of the RNSLA within the injection valve prior to the injection stage. RNSLA may be lowered into the valve body by a suitable tool to a position where the selective locking dogs 58 engage the selective nipple profile 16 in upper flow tube 15. At this point the RNSLA will be physically connected to the upper flow tube; however flapper valve 27 is still in the closed position.

Figure 6:
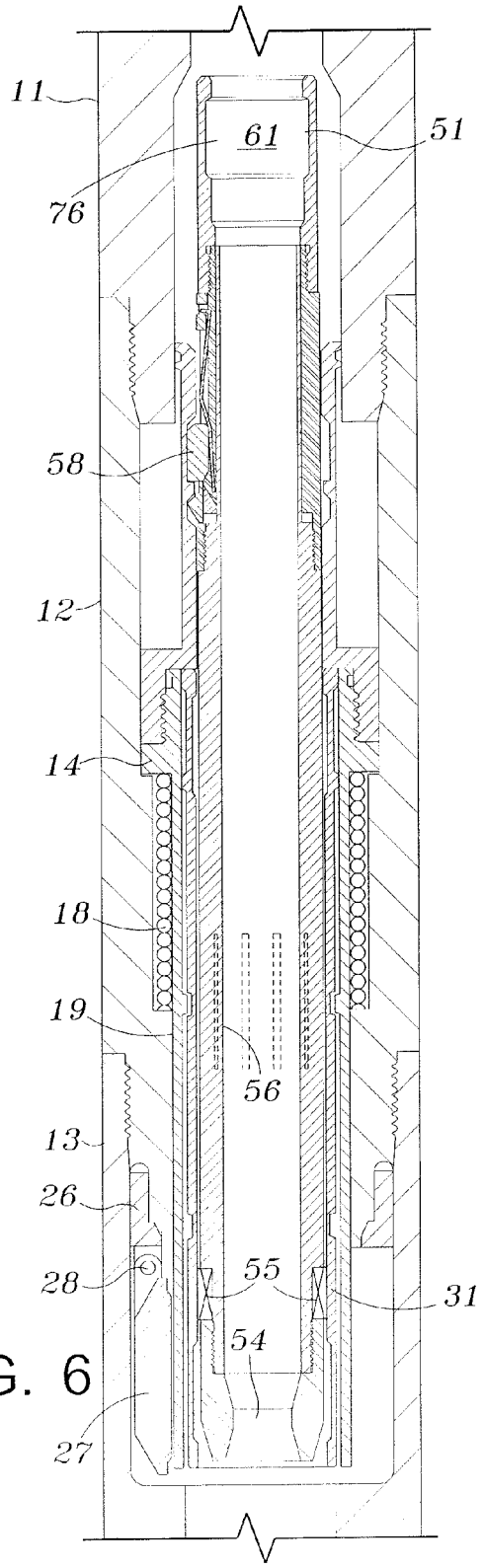
FIG. 6 is a cross sectional view of a valve in an open injection position.

The next step in the process is to pump a fluid such as water under pressure into the valve body. As the fluid flows through the RNSLA, a pressure drop will occur across orifice 54 which will cause the RNSLA and upper flow tube assembly 15, 14, as well as shiftable flow tube 31 to move downhole as shown in FIG. 6.

This movement will compress spring 18. The downhole portions of both the upper flow tube and lower flow tube will be forced into contact with flapper valve 27 and as they are moved further by the pressure differential, they will open the flapper valve to the position as shown in FIG. 6.

As long as the fluid is being pumped the injection valve will remain open. However when the pumping stops, compressed spring 18 will move the RNSLA and the upper and lower flow tubes back to the position shown in FIG. 5 in which the flapper valve is in the closed position.

Figure 7:
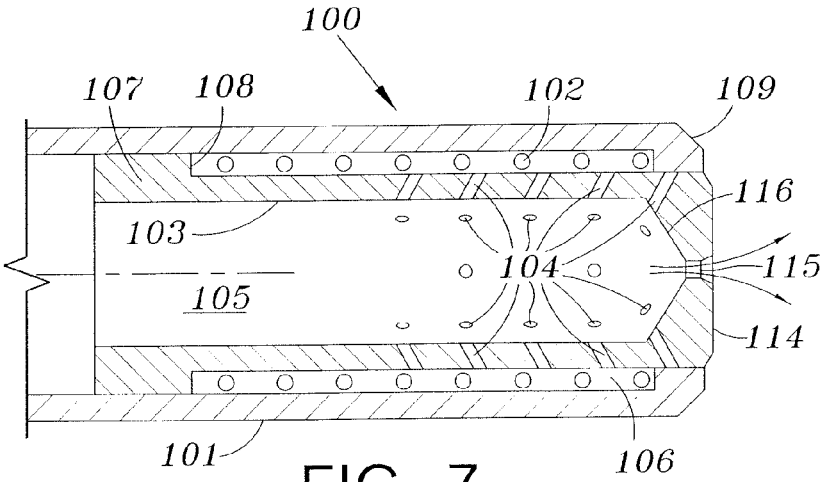
FIG. 7 is a cross-sectional view of a second embodiment of a retrievable nozzle selection lock assembly according to the invention.

FIG. 7 illustrates a second embodiment of the invention. In this case a variable output nozzle assembly 100 replaces the nozzle 53 shown in FIGS. 3 and 4.

Variable output nozzle assembly 100 includes an outer tubular cylindrical casing 101. An axially moveable cylindrical sleeve 103 having an enlarged portion 107 is positioned within casing 101 and has an end face 114 that extends outwardly of casing 101. Sleeve 103 has an interior flow passage 105 and also has a plurality of outlet ports 104 that are axially and radially spaced about its longitudinal axis. Sleeve 103 terminates in an end face 116 that includes an outlet orifice 115. A coil spring 102 is positioned between the inner surface of casing 101 and the outer surface of sleeve 103 as shown in FIG. 7. In the relaxed position of FIG. 7, one end of the coil spring 102 abuts against shoulder 108 on enlarged portion 107 of sleeve 103 and the other end abuts against end face 109 of the casing 101.

Figure 8:
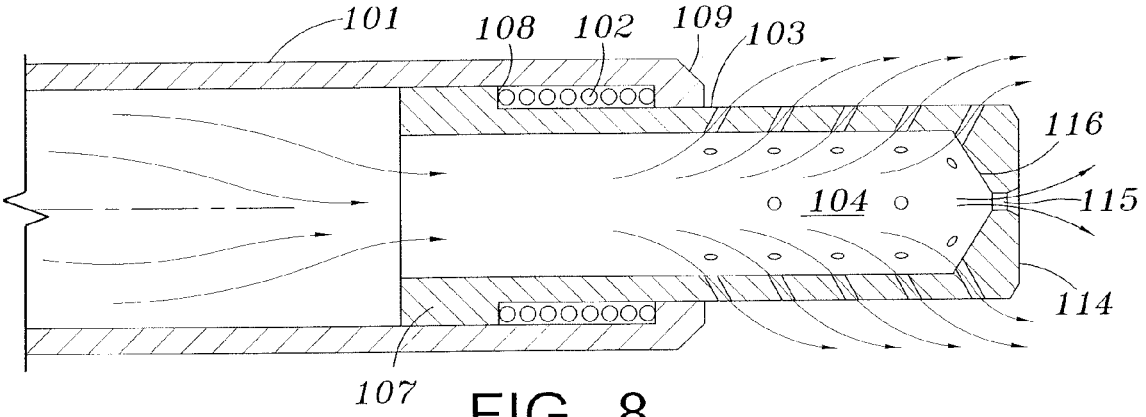
FIG. 8 is a cross-sectional view of the embodiment of FIG. 7 shown in a fully open condition.

At lower flow rates, the pressure drops across orifice 115 will be sufficient to move the lower flow tube to a position keeping flapper valve 27 open. As the flow rate increases, sleeve 103 is moved axially to sequentially move outlet ports 104 past the end face 109 of casing 101 as shown in FIG. 8, thereby allowing more fluid to exit the nozzle to proceed downhole of the flapper valve.

Figure 9:
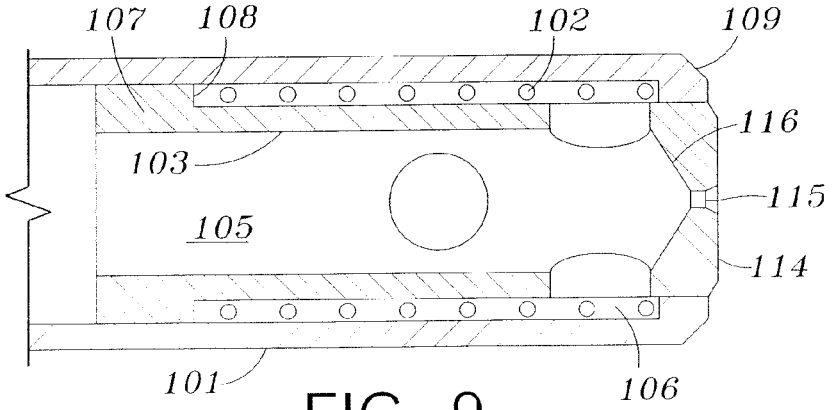
FIG. 9 is a cross-sectional view of a third embodiment of a retrievable nozzle selective lock assembly according to the invention.

FIG. 9 illustrates a variation from the shape and location of the outlet ports. In this embodiment outlet ports may be relatively large circular openings 114 that are axially offset with respect to one another. Openings 114 may also be elliptical or wedged shape or of any geometric shape.

The spring constants of springs 18 and 102 are chosen so that as fluid flow begins, the RNSLA will first move in a downhole direction opening the flapper valve before sleeve 103 moves in a downhole direction.

Figure 10:
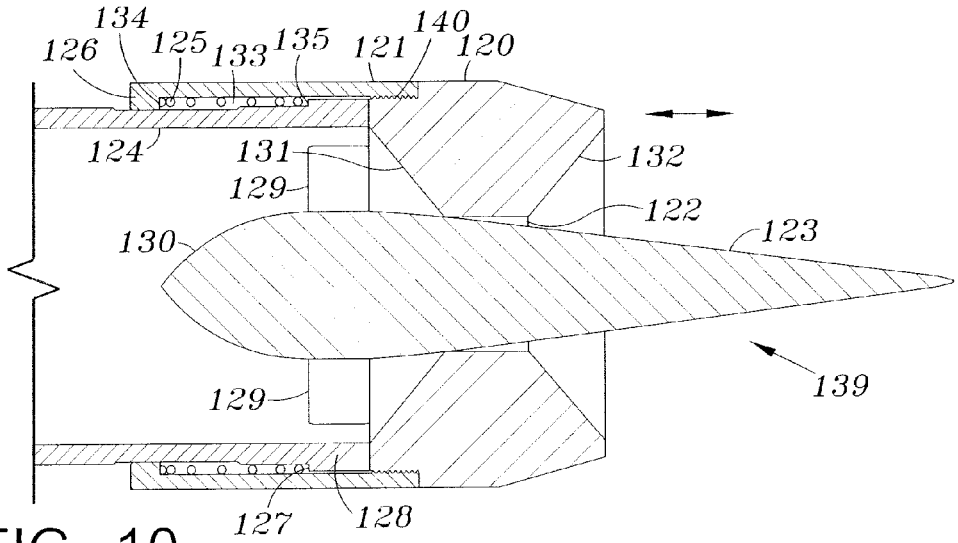
FIG. 10 is a cross-section view along line 10-10 of FIG. 11 of a fourth embodiment of a retrievable nozzle selective lock assembly according to the invention.
Figure 11:
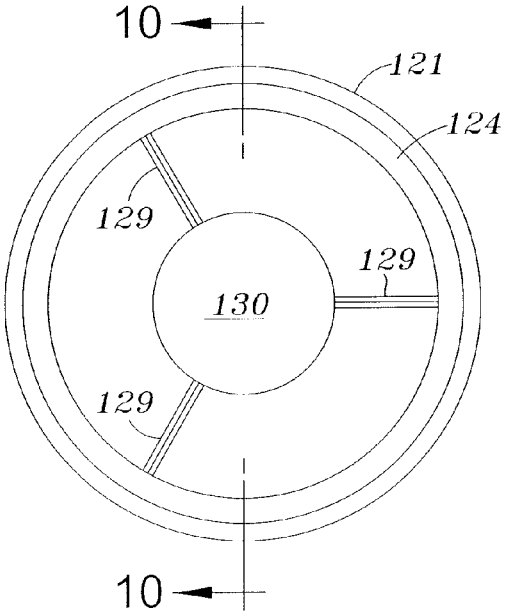
FIG. 11 is an end view of the retrievable nozzle assembly of FIG. 10.
Figure 12:
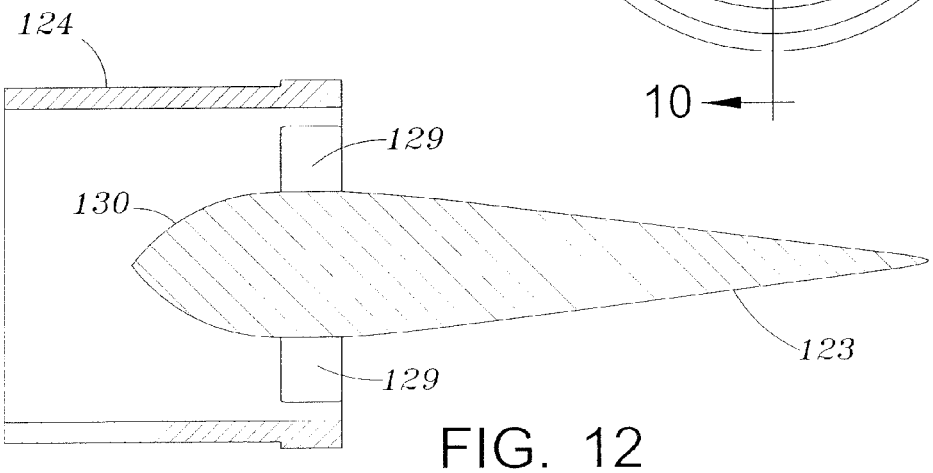
FIG. 12 is a cross-sectional view of the nozzle core member of the embodiment of FIG. 10.

FIGS. 10-12 illustrate yet a further embodiment of the invention.

In this embodiment the variable output nozzle assembly includes a first fixed portion including a cylindrical tubular casing 124 having a solid conical core member 139 supported therein by a plurality of struts 129 as shown in FIGS. 11 and 12. An outer tubular sleeve member 120 is fitted over casing 124 and includes a constricted portion 122 and conical portions 131 and 132 on either side of constricted portion 122. Conical member 139 has a first enlarged portion 130 followed by a tapered cone portion 123. Outer sleeve member 120 includes a thin walled portion 121 that extends to an annular shoulder 126 such that an annular space 133 is formed between casing 124 and thin walled portion 121. A coil spring 125 is positioned within space 133 such that one end of the spring abuts against a shoulder 134 on enlarged portion 126 of thin walled portion 121 and abuts against a shoulder 135 provided on tubular casing 124. Thin wall portion 121 is detachably secured to outer sleeve member 12 at 140 for example by threads. In the position shown in FIG. 10, the outer surface of core member 139 engages constriction 122 so as to prevent flow.

As the flow rate of fluid is increased, outer sleeve member 120 will move to the right as viewed in FIG. 10. Due to the tapering of cone section 123, the outlet area of the nozzle at 122 will increase as the flow rate increases. Thus at lower flow rates sufficient force will be provided to maintain the flapper valve in the open position as well as at high flow rates.

The embodiments according to FIGS. 7-12 provide an infinitely variable nozzle which will minimize pressure drop over a range of injection flow rates. They provide full open flapper protection over the full range of injection rates thus eliminating flapper chatter due to partial valve opening during injection.

Figure 3:
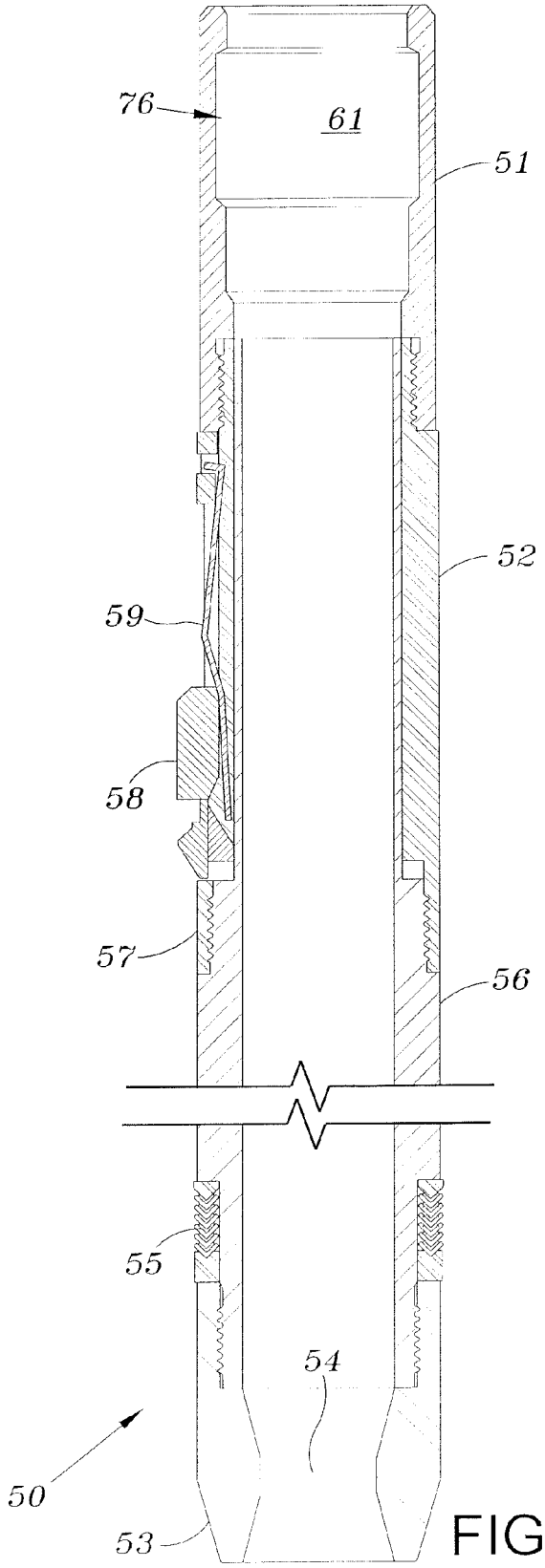
FIG. 3 is a cross-sectional view of the retrievable orifice selective lock assembly.
Figure 4:
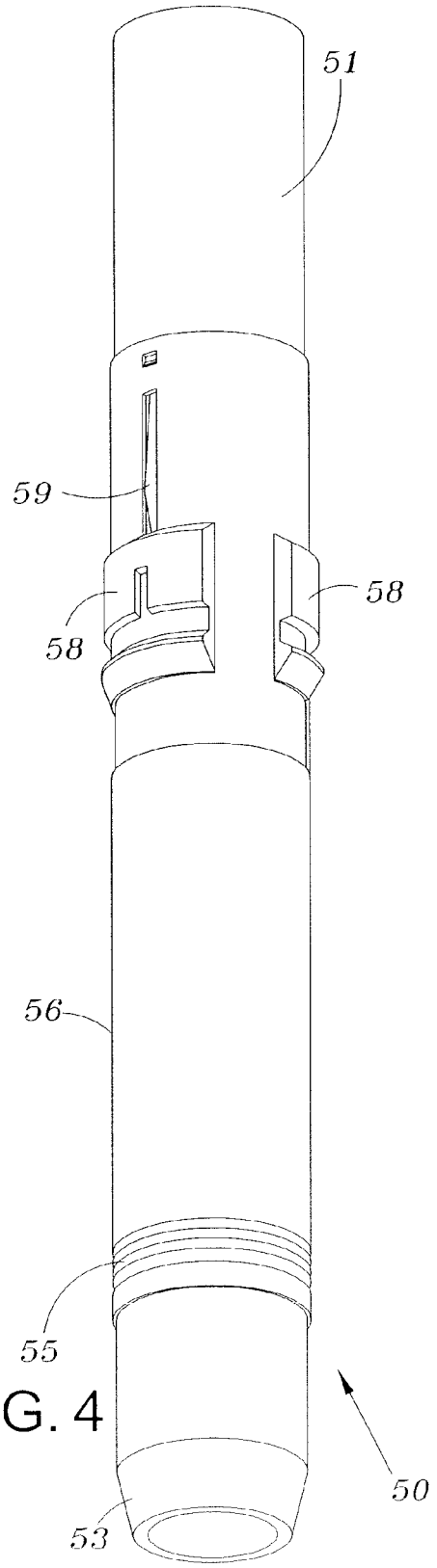
FIG. 4 is a perspective view of the retrievable nozzle selective lock assembly.

The variable output nozzles of FIGS. 7-12 can be substituted for the nozzle 53 shown in FIG. 3 so that they can be placed and retrieved as a part of the RNSLA shown in FIGS. 3 and 4.

Figure 13:
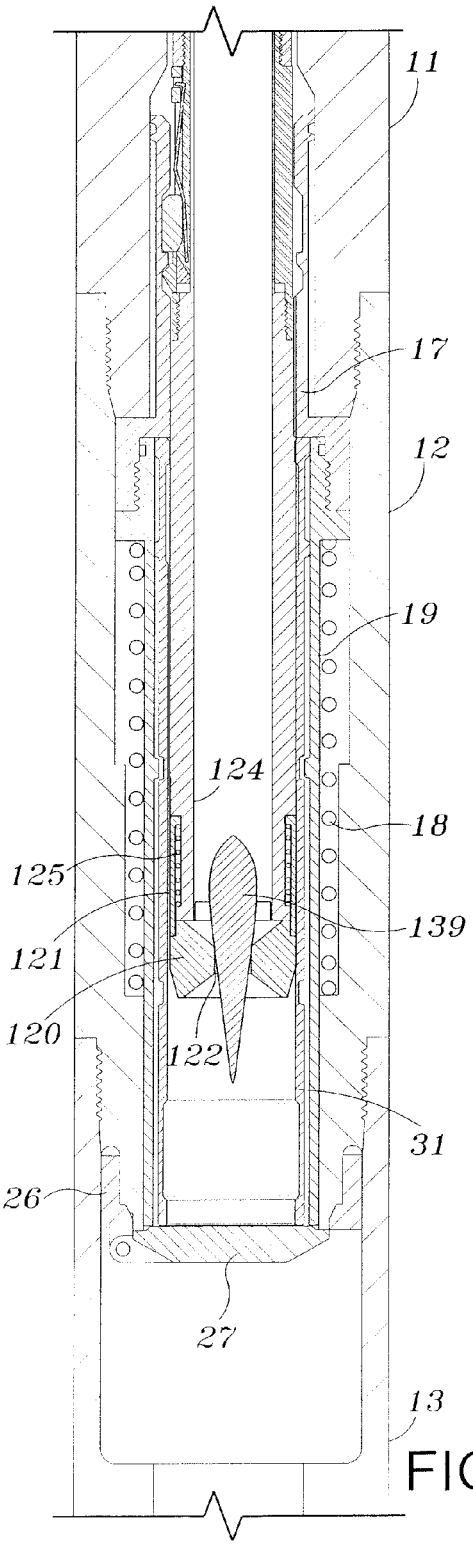
FIG. 13 is a cross-sectional view of an embodiment of the valve according to the invention with the variable nozzle assembly of the embodiment shown in FIG. 10 in the closed position.
Figure 14:
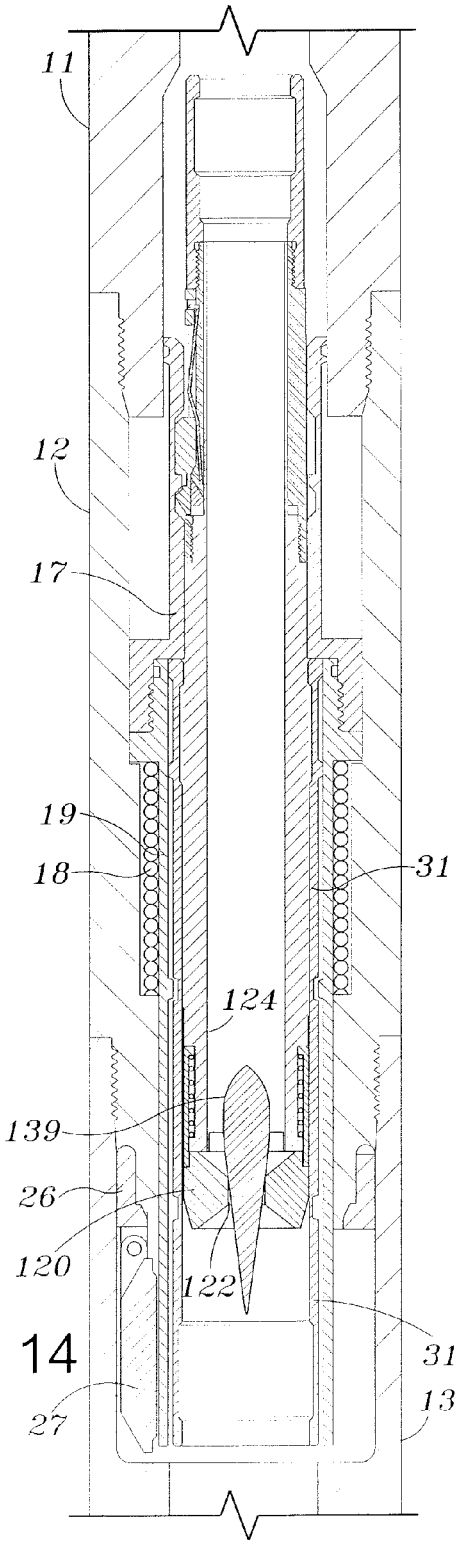
FIG. 14 is a cross-sectional view of the embodiment shown in FIG. 13 with the flapper valve in the open position.
Figure 15:
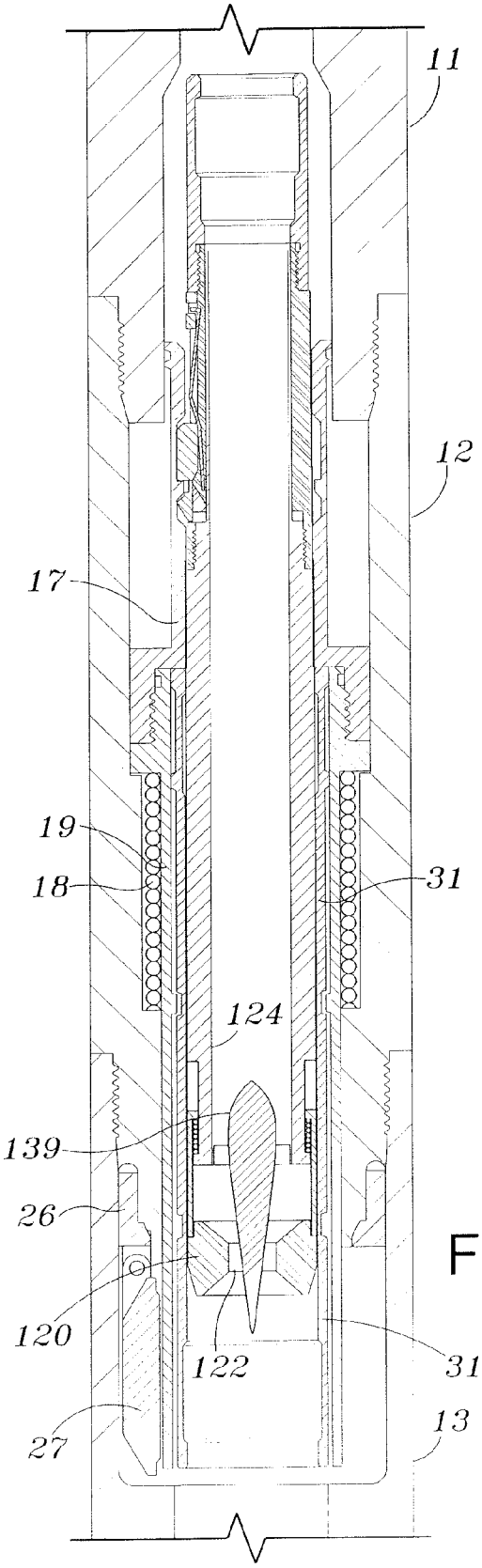
FIG. 15 is a cross-sectional view of the embodiment shown in FIG. 13 with the flapper valve in the open position and the variable orifice in the open position.

FIGS. 13-15 shown the sequential opening of the flapper valve and the variable orifice as flow is initiated in the well according to the embodiment of the variable orifice shown in FIG. 10. The difference between FIGS. 5 and 6 and FIGS. 13-15 is that the nozzle assembly 53 of FIGS. 5 and 6 has been replaced by the nozzle assembly of FIG. 10.

In the position shown in FIG. 13, the flapper valve 27 is closed and the outer surface of core member 139 engages constriction 122 so as to prevent flow through the nozzle. The lower ends of upper flow tube 19 and lower flow tube 31 are positioned adjacent the flapper valve 27. As fluid flow begins the upper and low flow tube along with the variable orifice nozzle assembly will move downwardly to the position shown in FIG. 14 due to fluid pressure thereby compressing spring 18. The spring constants for spring 18 an spring 125 are selected so that during initial fluid flow the upper and lower flow tube as well as the variable orifice nozzle assembly will move to the position shown in FIG. 14 with the variable orifice 122 still in a closed position. However, as fluid pressure and flow increases, outer sleeve member 120 will move downwardly with respect to tubular casing 124 in which cone member 139 is fixed to the position shown in FIG. 15. In this position fluid will flow through variable orifice 122.

Figure 16:
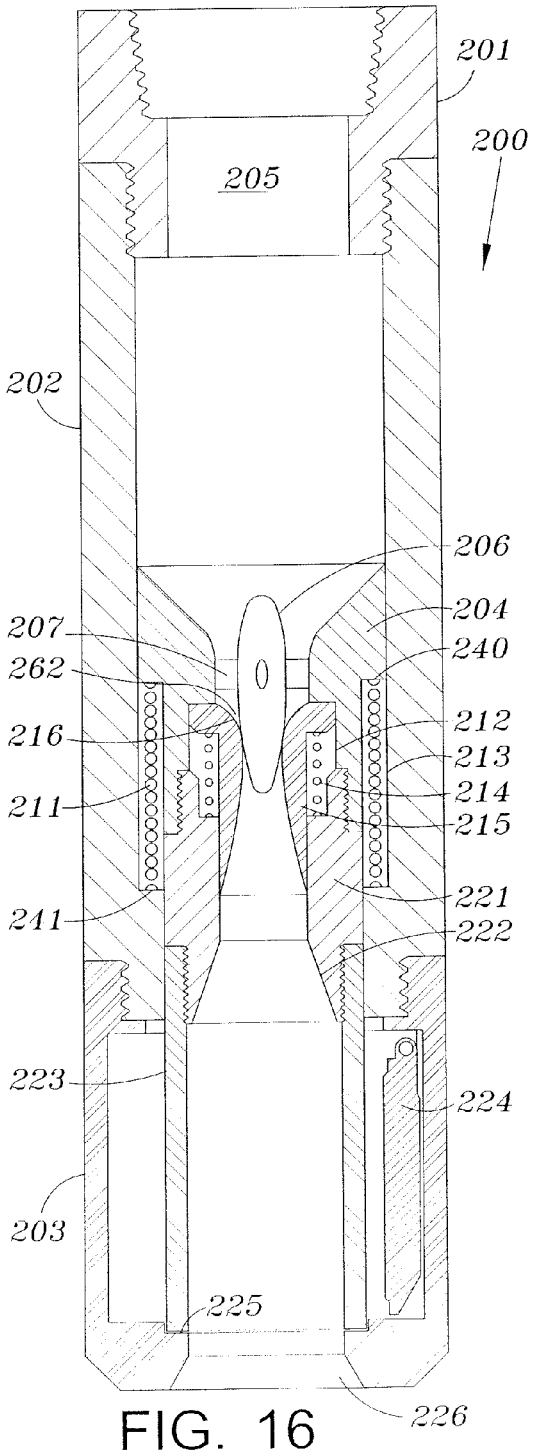
FIG. 16 is a cross-sectional view of a further embodiment of the invention showing the valve in the open position.
Figure 23:
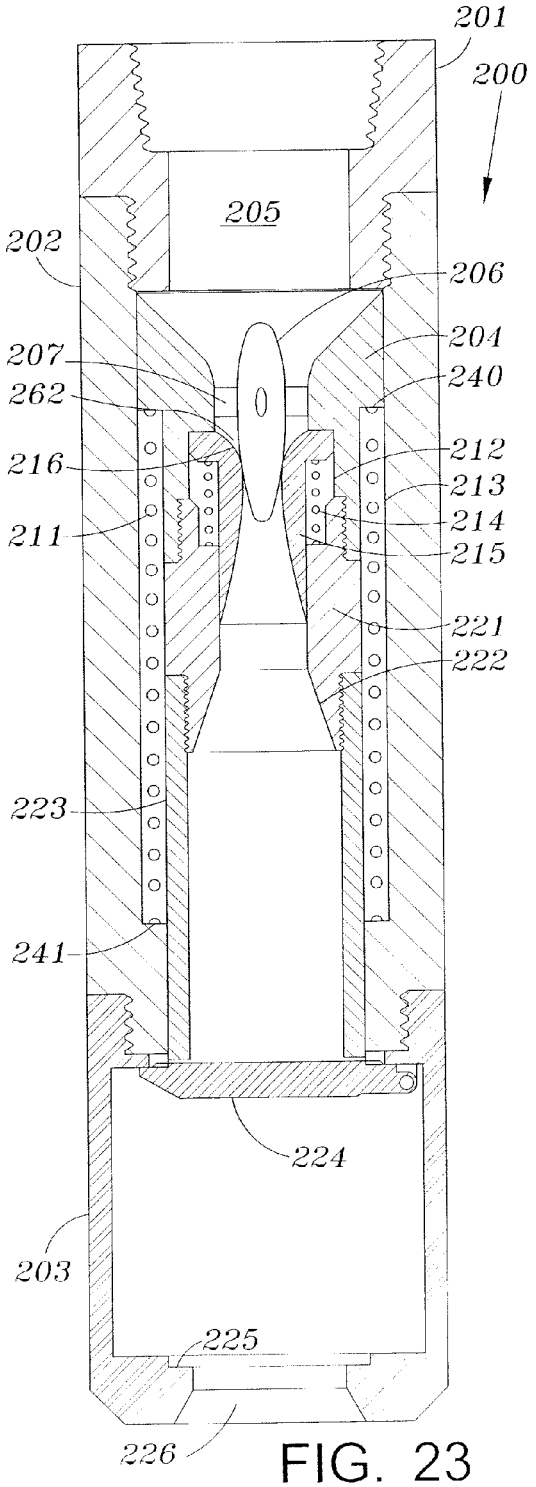
FIG. 23 is a view similar to FIG. 16 showing the flapper valve in the closed position.

FIG. 16 illustrates a further embodiment of a wireline retrievable valve, as is well known by those with ordinary skill in the art, shown with the flapper valve in an open, injection position. Valve 200 includes a valve body having an upper lock adapter 201, and intermediate body housing 202 and a lower body housing 203 in which a conventional flapper valve element 224 is rotatably mounted. Valve element 224 is spring biased to a closed position as shown in FIG. 23. Valve 200 also includes an inlet 205 and outlet 226.

Figure 17:
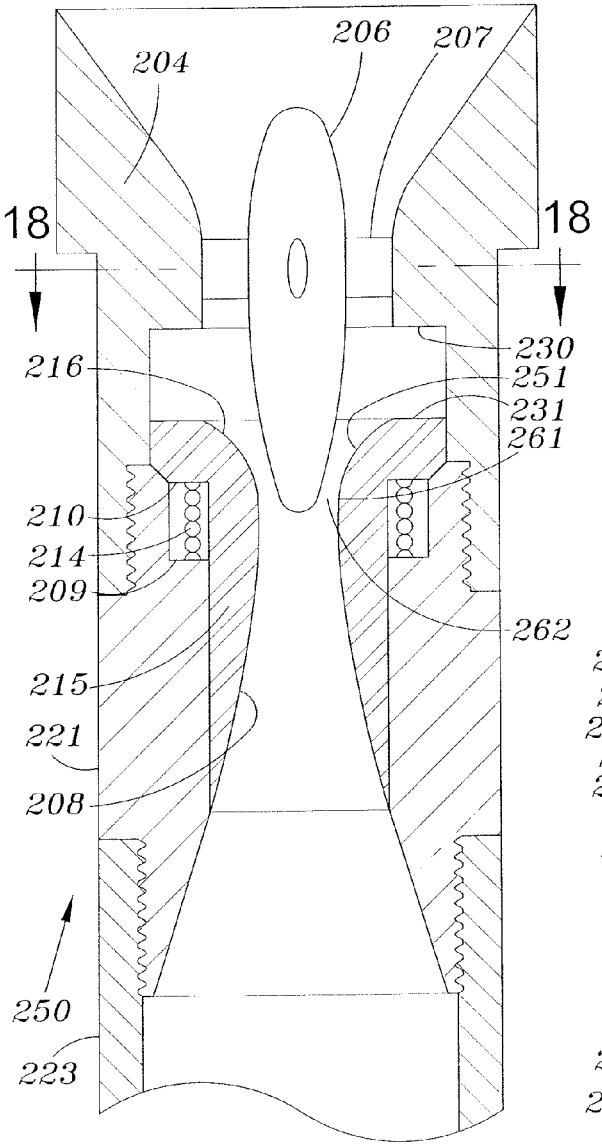
FIG. 17 is a cross-sectional view of the axially movable valve assembly with the secondary valve in the open position.
Figure 19:
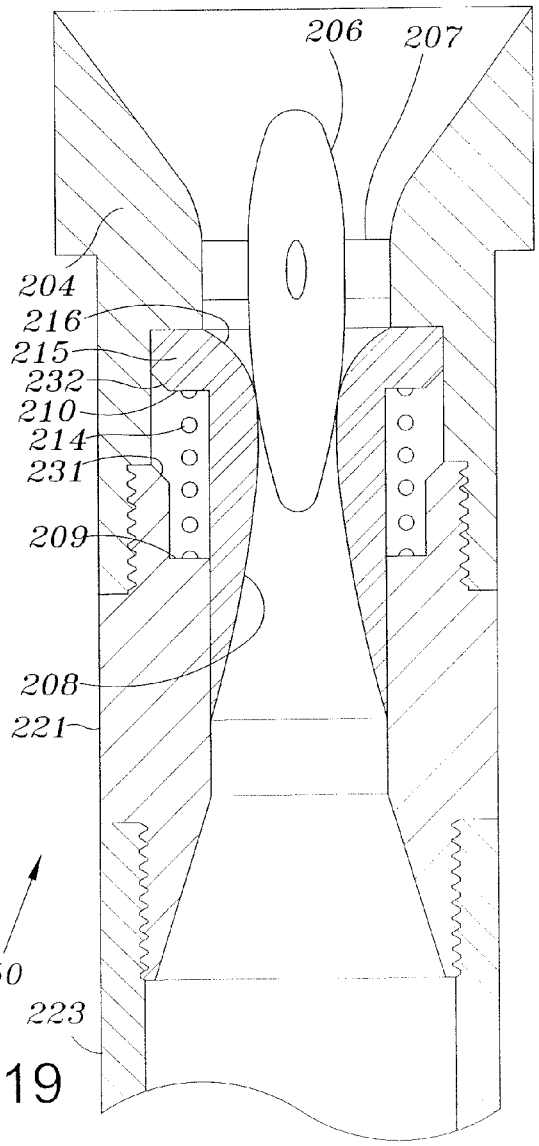
FIG. 19 is a cross-sectional view of the axially moveable valve assembly with the secondary valve in the closed position.
Figure 18:
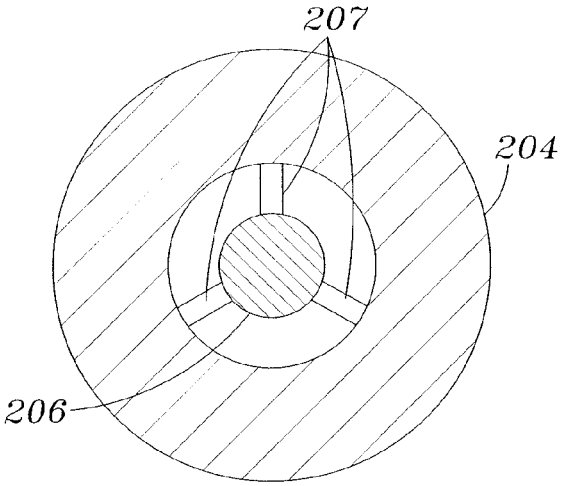
FIG. 18 is a cross-sectional view taken along line H? 18-18 of FIG. 17.

An axially movable valve assembly 250 shown in FIGS. 17 and 19 is positioned within the valve body and includes an inlet portion 204, an intermediate portion 221 and a sleeve portion 223. A spring 211 is captured between a shoulder 240 formed in the outer surface of inlet portion 204 and a step 241 formed in the interior surface 213 of intermediate body housing 202. A tear drop body member 206 similar to body 130 shown in FIG. 12 is supported within inlet portion 204 by a plurality of struts 207. An axially movable nozzle 215 is positioned within inlet portion 204 and intermediate portion 221 of the valve assembly. Body 206 and movable nozzle 215 form a secondary valve having a variable annular fluid passageway 262 as shown in FIG. 17.

Nozzle 215 has a converging inlet section 216, a throat portion 261 and a diverging outlet section 208. Nozzle 215 moves axially with the second valve assembly between shoulder 230 in inlet portion 204 and a shoulder 231 formed on intermediate portion 221 of the second valve assembly as shown in FIGS. 17 and 19. A spring 214 is positioned between a shoulder 210 on the outer surface of the nozzle and a step 209 on the intermediate portion 221. Axial movement of the nozzle 215 in a downward direction will compress spring 214 as shown in FIG. 17. Nozzle 215 and body 206 form a valve.

Second valve assembly 250 includes an elongated sleeve 223 coupled to intermediate portion 221 for example by threads. Sleeve 223 is adapted to move downwardly to open flapper valve 224 as shown in FIG. 16 when fluid is pumped into the well via tubing 403 shown in FIG. 21. Further downward movement of sleeve 223 is restrained by a shoulder 225 formed in lower body housing 203.

Figure 21:
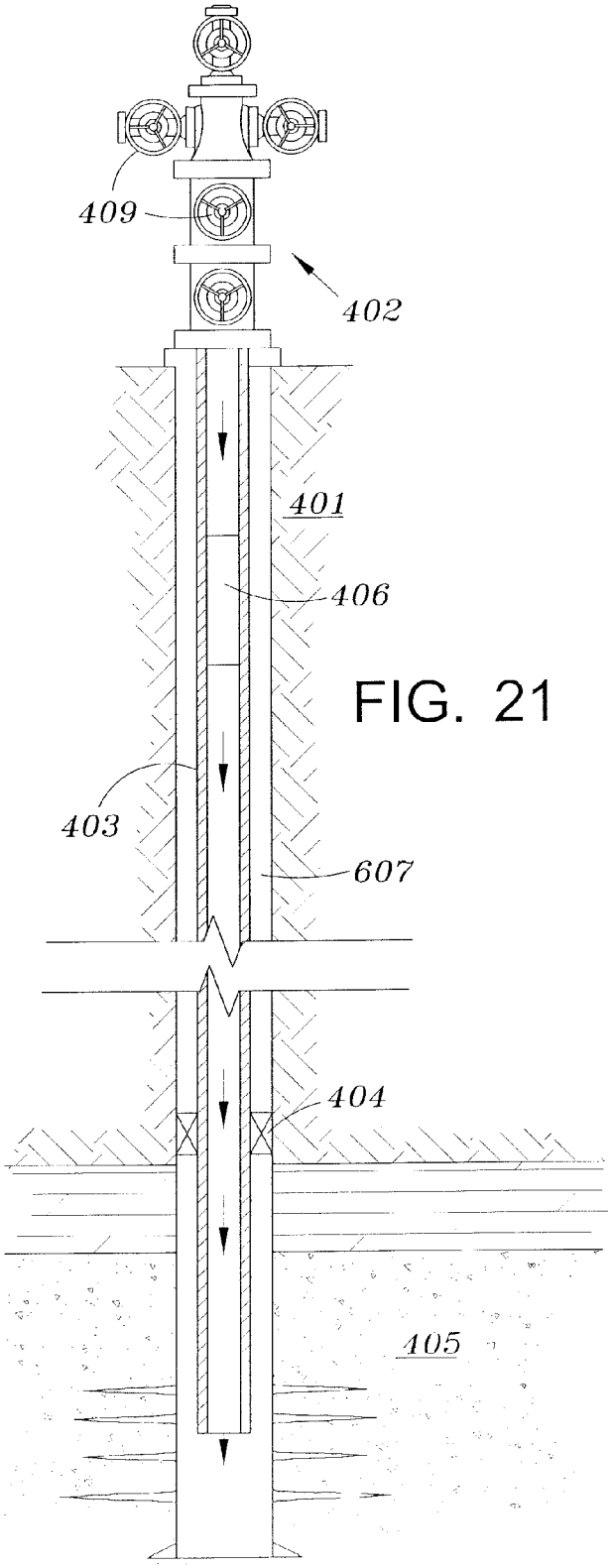
FIG. 21 is a schematic representation of an injection well.

FIG. 21 shows the location of the valve 406 within a well. A well bore 607 extends down to a formation 405 where the injected fluid is to be delivered. A tubular string 403 is connected to the well head 402 which typically includes a plurality of valves 409. A packer 404 is placed between the tubular string 403 and the well casing.

Figure 22:
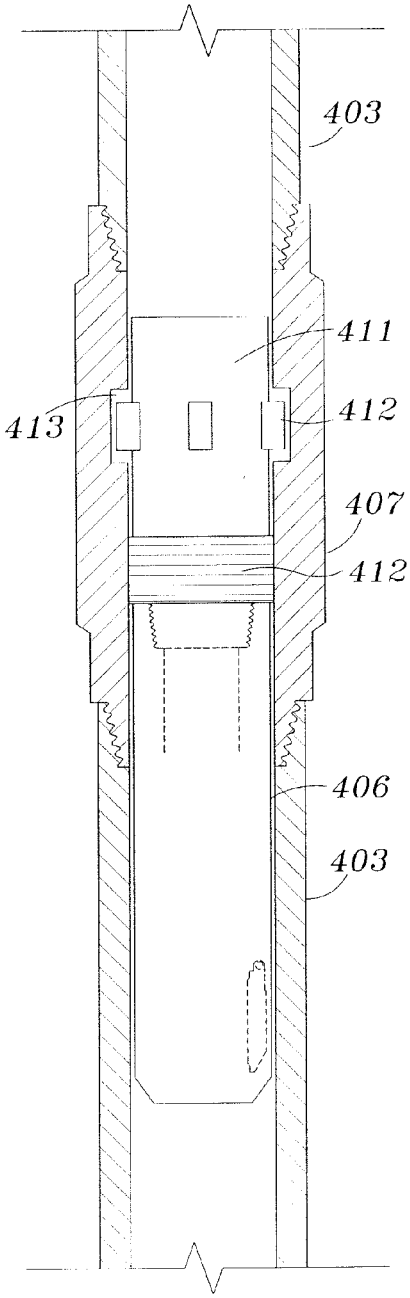
FIG. 22 is a schematic showing of an injection valve positioned within a tubular string of an injection well.

In operation, injection fluid is pumped through the well head into tubular string 403 in which valve 406 is located. As shown in FIG. 22, valve 406 can be selectively positioned within the tubing string by a wireline nipple 407 for the tubulars 403 and by wireline lock 411 having dogs 412 that cooperate with a groove 413 in the nipple in a manner well known in the art. Wireline lock 411 has packing 412 to seal the lock within the nipple 407.

Fluid pressure will initially cause second valve assembly 250 to move downwardly to the position shown in FIG. 16 such that sleeve 223 moves flapper valve to the open position shown in FIG. 16. Continued fluid flow will cause nozzle 215 to move downwardly away from body 206 as shown in FIG. 17 to thereby allows fluid flow through second valve assembly 250.

Figure 20:
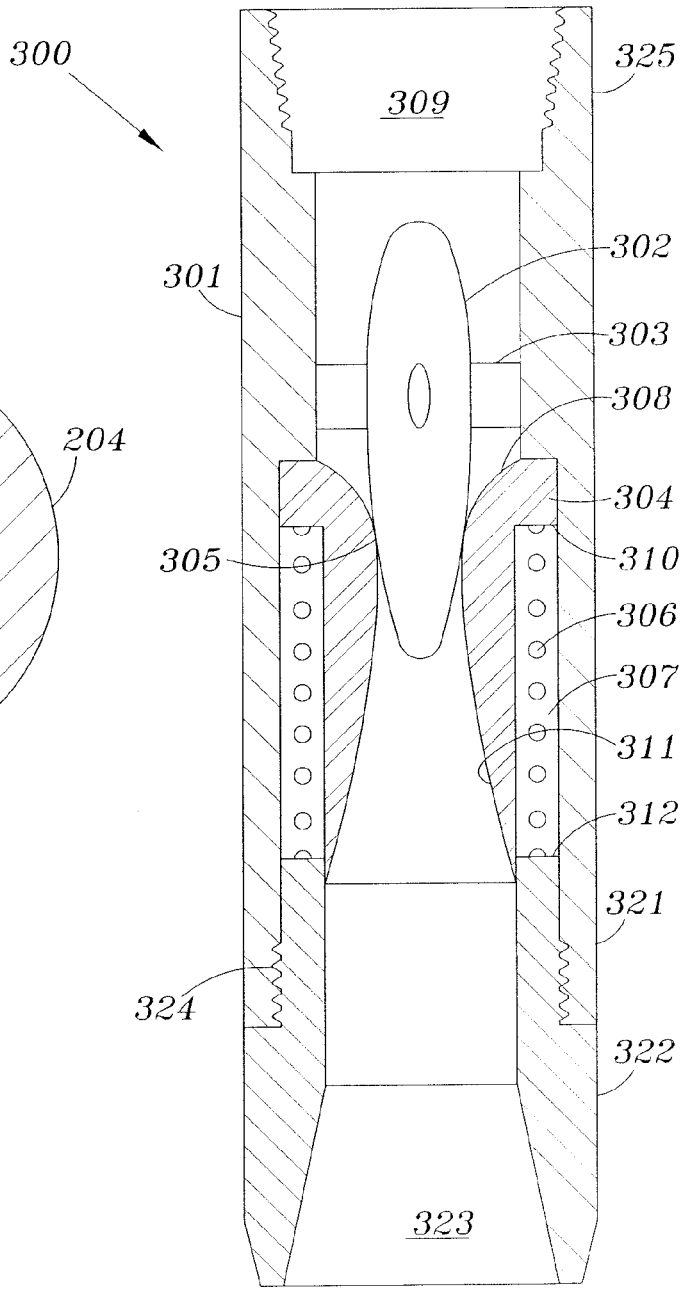
FIG. 20 is a cross-sectional view of a flapperless safety valve according to an embodiment of the invention.

Yet a further embodiment of the invention is illustrated in FIG. 20. This is an embodiment of the injection valve without a flapper valve. The valve 300 includes a main body housing 301 and a lower body housing 322 attached to main body housing 301 via threads 324 as an example.

Main body portion 301 has an upper connection 325 suitable for connection to a wireline lock 411 for example. The valve includes an inlet 309 and outlet 323 for the injection fluid. A solid tear-shaped body 302 is fixed within the main body housing 301 by a plurality of struts 303. A nozzle member 304 includes a converging inlet 308 and a diverging outlet 311. A valve seat 305 is formed between the conveying and diverging portions of the nozzle and cooperates with body 302 to form a variable constricted flow passage through the valve as nozzle 304 moves axially. Nozzle 304 is moved downwardly against spring 306 in spring chamber 307 by a pressure differential. Spring 306 is captured between a shoulder 310 on the exterior surface of the nozzle and a step 312 formed on the upper end of lower body housing 322.

When fluid is pumped down to the valve, nozzle 304 will move downwardly to open up an annular fluid passageway between body 302 and nozzle 304. When fluid flow is terminated, spring 306 which is compressed as nozzle 304 is moved downwardly will shift nozzle 304 in an upward direction thus bringing surface 305 into contact with body 302 thereby closing the annular fluid passageway and preventing flow back of fluid.

FIG. 24-34 depict a further embodiment of the dual barrier valve of the invention.

Figure 24:
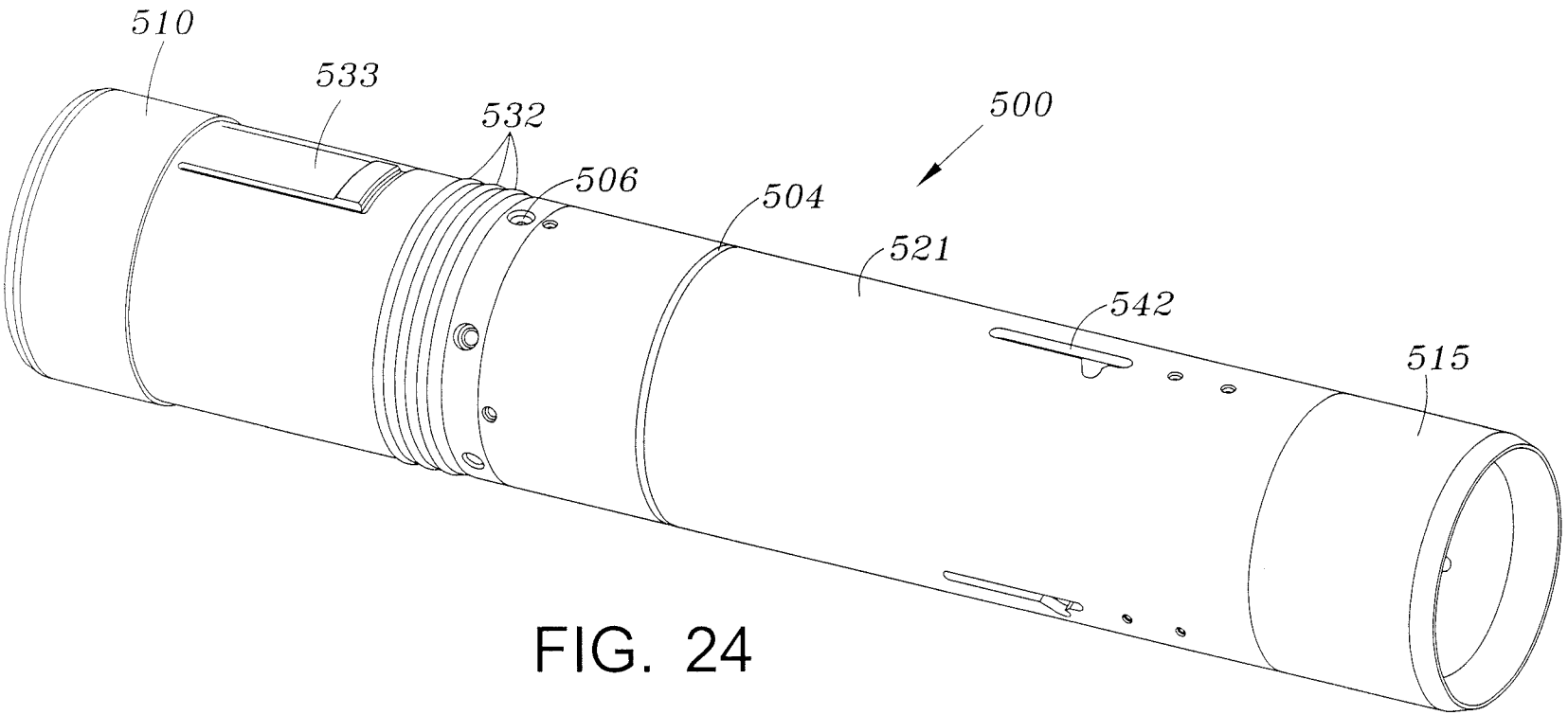
FIG. 24 is a perspective view of a further embodiment of a retrievable variable outlet assembly according to the invention.

FIG. 24 illustrates a retrievable nozzle select lock assembly (RNSCA) 500 which includes a variable orifice insert similar to that shown in FIGS. 13 and 14 at 19, 31, and 124. The RNSCA is designed to be positioned within an injection valve which includes an upper valve body member 11, a middle valve body member 12 and a lower valve body member 13 which includes a flapper valve assembly 26, 27.

The RNSCA includes an upper sleeve 501 have a standard internal fishing neck profile 510. A middle sleeve 508 is attached to upper sleeve 501 by a plurality of pins 506. A first set of magnets 502 is positional between the upper and middle sleeves. Middle sleeve 508 terminates in a tapered valve seat 516. An outer sleeve member 521 is axially movable with respect to middle sleeve 508. A pair of magnets 503 are attached to outer sleeve member 521 and move with the sleeve 521. Magnets 502 and 503 have opposite poles that attract each other. Pin 512 is secured to middle sleeve 508 and is positioned within a J-slot 542 formed in outer sleeve 521.

Figure 25:
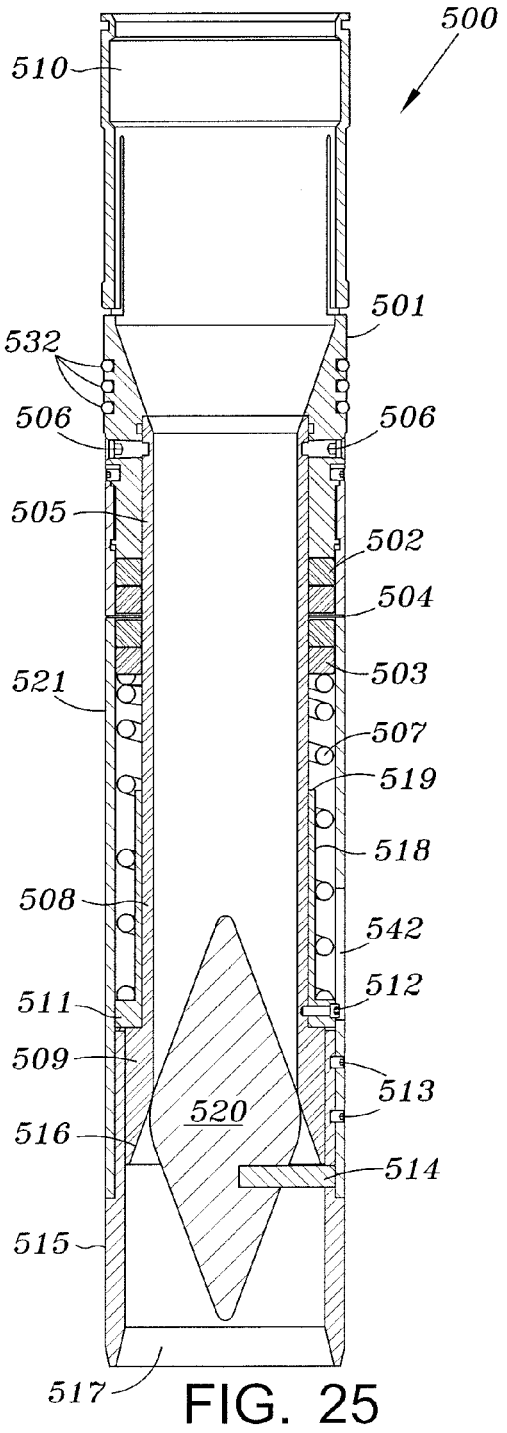
FIG. 25 is a cross-sectional view of the embodiment of FIG. 24 showing the variable outlet in a closed position.

A gap 504 is formed between upper sleeve 501 and outer sleeve 521. A slightly compressed spring 507 is positioned between middle sleeve 508 and outer sleeve 521 as shown in FIG. 25.

The RNSCA includes a plurality of seals 532 and a locking tab 533. A lower sleeve 515 is attached to outer sleeve 521 by one or more pins 513. Lower sleeve 515 supports inner valve member 520 by a plurality of struts 514. A spring guide sleeve 518 with a shoulder 511 surrounds middle sleeve 508. Lower sleeve 515 includes an outlet 517. Middle sleeve is enlarged at 509 to accommodate valve seat 516.

Figure 27:
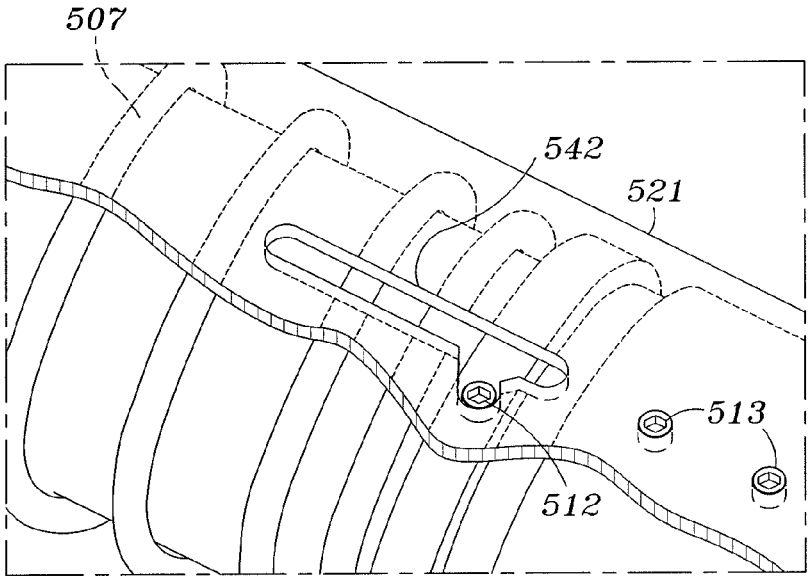
FIG. 27 is a view showing the position of the outer sleeve in the run-in position.
Figure 28:
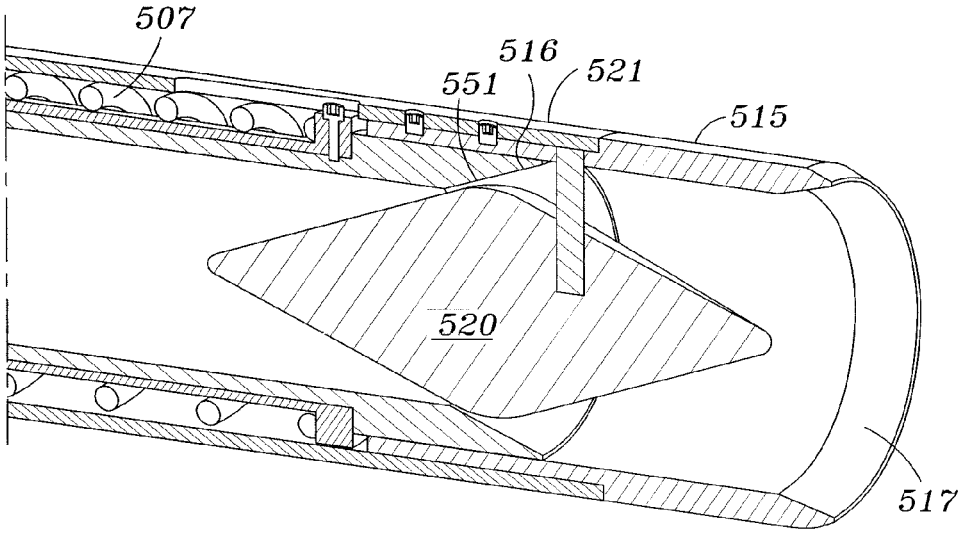
FIG. 28 is a view showing the position of the inner movable valve member in the run-in position.

FIGS. 27 and 28 show the portion of inner vale member 520 in the run in position. Pin 512 is located in the hook portion of the J-slot of outer sleeve 521. In this position inner valve member 520 is slightly spaced from valve seat 516 so that as the dual valve assembly is lowered into the well, fluid in the well may escape to the well head via an annular orifice 551 between valve seat 516 and valve number 520 as shown in FIG. 28.

Figure 29:
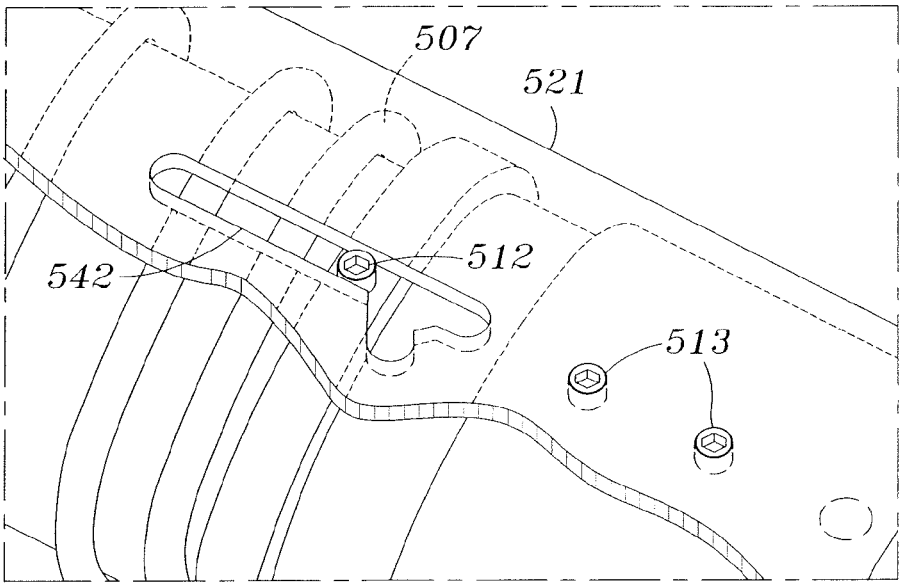
FIG. 29 is a view showing the resetting position of the outer sleeve in the resetting position.
Figure 30:
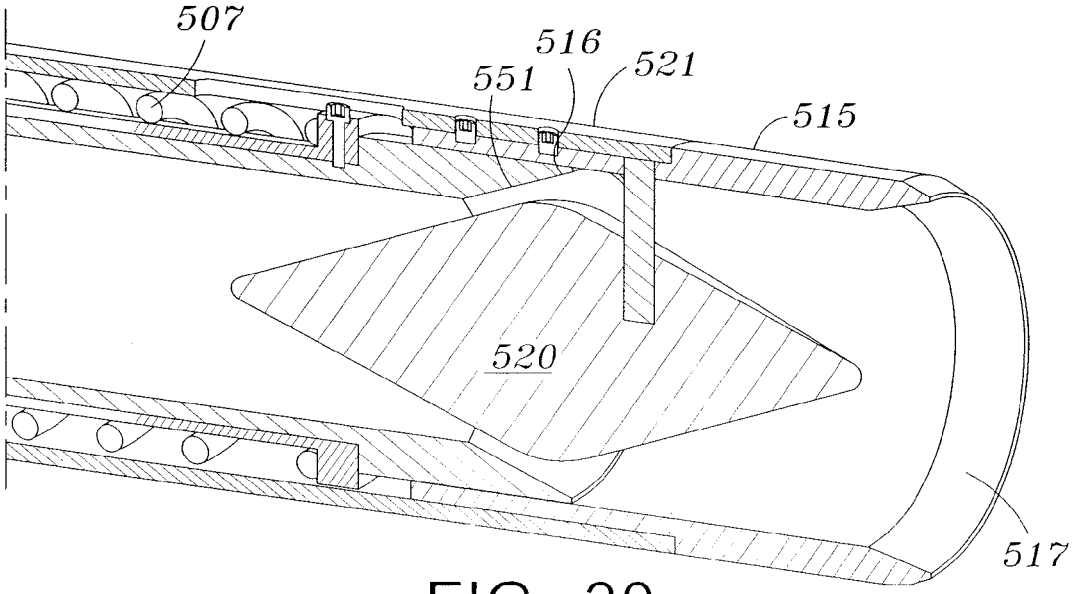
FIG. 30 is a view showing the position of the inner movable valve member in the resetting position.

In the resetting position of FIGS. 29 and 30, outer sleeve 521 and lower sleeve 515 are movable down hole by fluid flow within the valve body and pin 512 is positional with the slot 542 as shown in FIG. 29.

Figure 26:
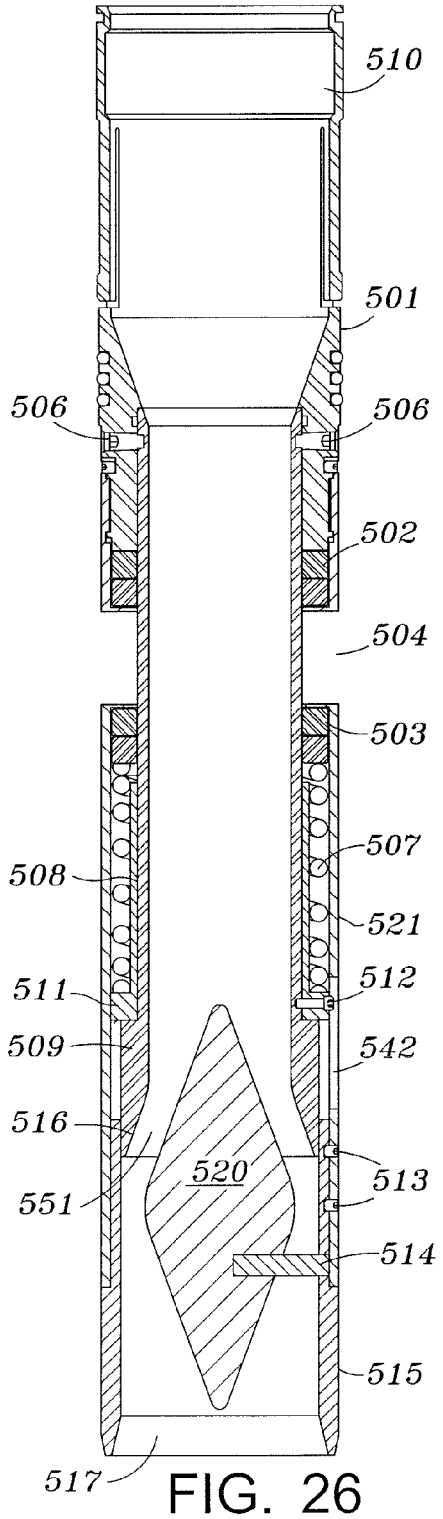
FIG. 26 is a cross-sectional view of the embodiment of FIG. 24 showing the variable outlet in an open position.
Figure 32:
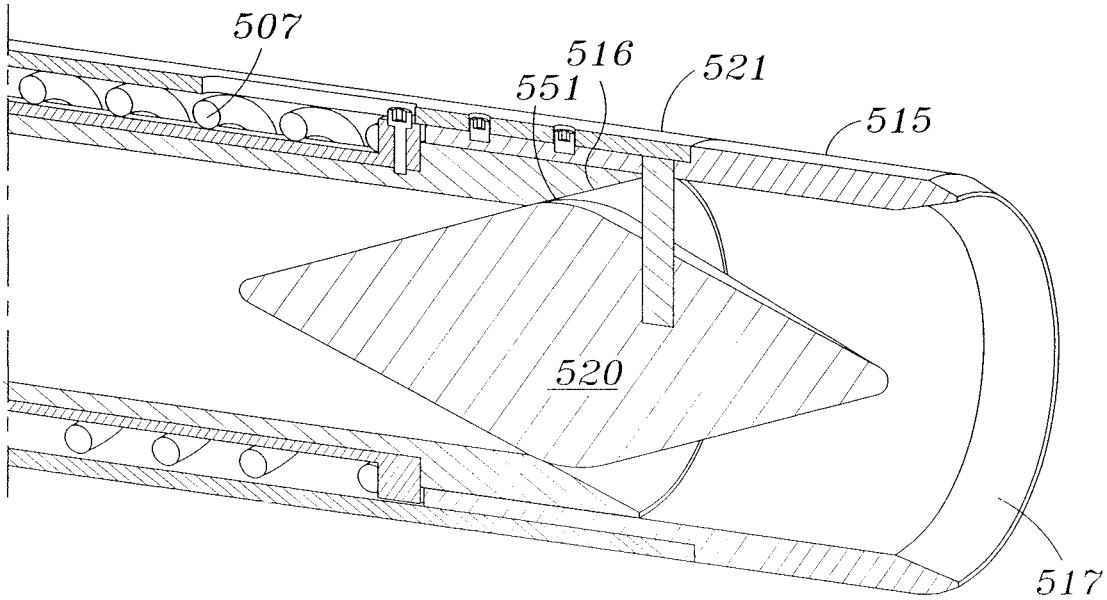
FIG. 32 is a view showing the position of the inner movable valve in the operational position.

This allows outer sleeve 521 and valve body 520 to move upwardly thereby closing the valve. The valve is now ready for operation as shown in FIG. 32. Water under a given pressure will move lower sleeve 515 in a downward direction to open flapper valve 27. As shown in FIG. 26 increased pressure will act to move valve body 520 away from valve seat 516 to allow injection of water into the well.

Figure 33:
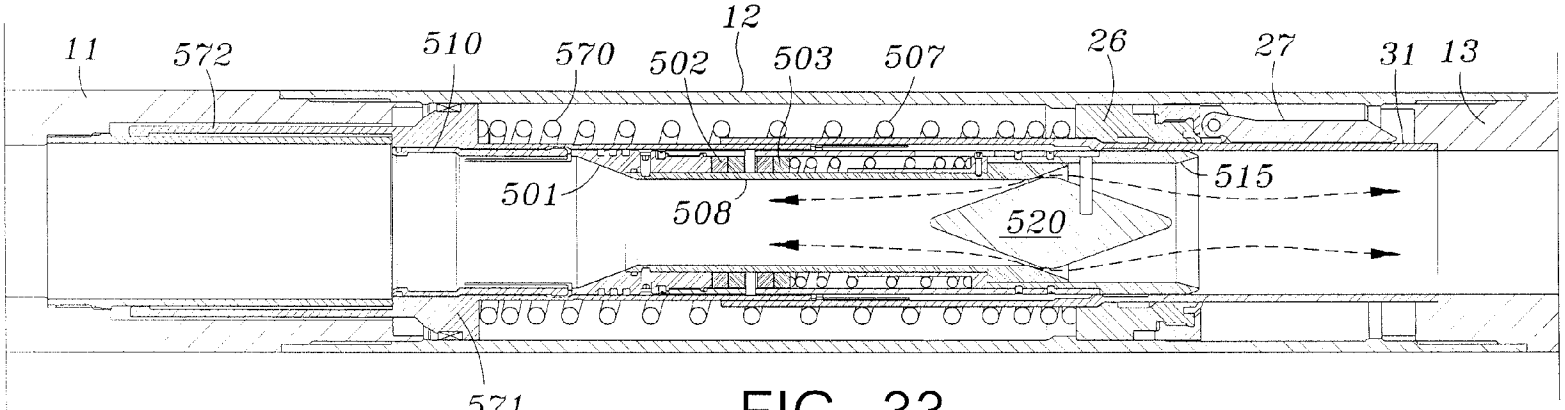
FIG. 33 is cross sectional view of the variable orifice insert positioned in the injection valve housing showing the valve in the run-in position.
Figure 34:
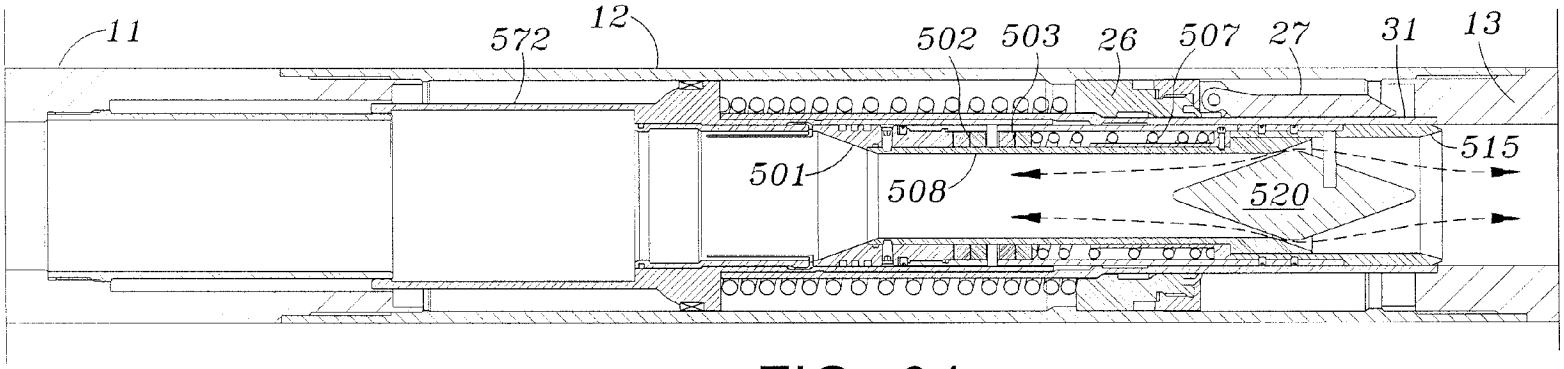
FIG. 34 is a cross sectional view of the variable orifice insert in the valve housing in the injection position.

FIGS. 33 and 34 show the variable orifice insert positioned within an injection valve housing which includes upper body member 11, middle body member 12 and lower body member 13. A power spring 570 is positioned between a flange 571 which is attached to upper flow tube 572 and the flapper support 26. As the variable orifice insert moves in a down hole direction, spring 570 is compressed as shown in FIG. 34.

Figure 31:
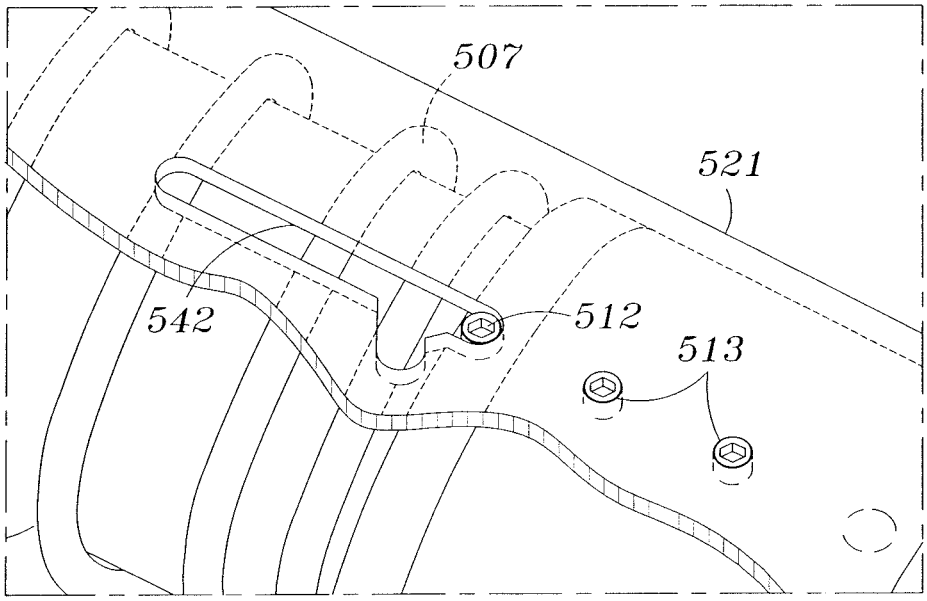
FIG. 31 is a view showing the position of the outer sleeve in the operational position.

FIG. 33 shows the valve in the run-in position with pin 512 positioned within slot 542 as shown in FIG. 27. FIG. 34 shows the valve in the resetting position where a low resetting flowrate will develop to fully stroke and lock the flow tubes together. Power spring 570 is compressed by shoulder 571 of upper flow tube 572. Pin 512 moves to the position shown in FIG. 29. When the flowrate is decreased the variable orifice insert resets into the fully closed position as shown in FIGS. 31 and 32. Power spring 570 returns the upper flow tube 572 to the initial position of FIG. 33 along with lower flow tube 31.

In this position the flapper valve 27 and the variable orifice insert are both in the fully closed position thus providing a dual barrier check valve for any fluid flowing out of the well. When injection resumes, the differential pressure developed across the insert is relatively high because it's held closed by the magnets. The variable orifice insert opens the flapper valve before any flow is established through the tool.

Consequently no flapper chattering is possible. As the flow rate is increased, the variable orifice inset will open to allow flow to pass through the variable orifice. As the orifice is opened by the flow, the magnetic force is decreased allowing very low operational differential pressure during injection operation. The operating differential pressure must be above the opening differential pressure for the flow tube and flapper system to stay open during injection. When the injection flowrate is decreased below a certain valve, the flapper will close protecting the surface from produced injection water.

The opening of the valve due to fluid flow is resisted by the spring force as it is displaced, by the spring pre load-force and by the magnetic force. These forces balance each other with the result that a low operating differential pressure is maintained which results in higher injection efficiency.

Figure 35:
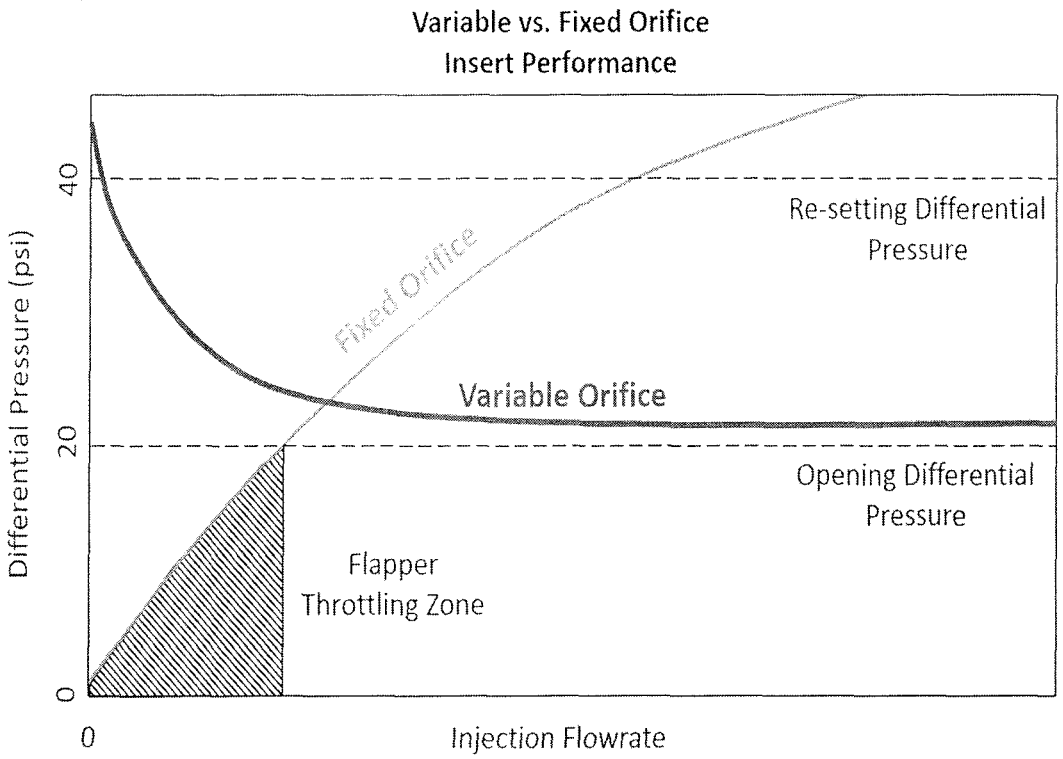
FIG. 35 is a graph that depicts the performance of a variable orifice nozzle insert vs. a fixed orifice.

FIG. 35 illustrates the performance of the variable orifice nozzle insert of the present invention vs. the fixed orifice of the prior art.

The horizontal axis is the injection flowrate and the vertical axis represents the differential pressure across the orifice.

With a fixed orifice nozzle, as the flowrate increases and the pressure differential is below 20 psi, the flapper element will chatter as shown in the shaded area until the opening differential pressure is above 20 psi.

Also the fixed orifice will take significantly higher flow to attain the required opening differential pressure. Also, the fixed orifice will require an even higher flow for re-setting the flow tube. Potentially, the re-setting differential pressure might not be achieved at all rendering the system useless.

In contrast, the variable nozzle of the present invention does not open until the flapper valve is moved to an open and protected position thereby completely eliminating chatter.

The variable orifice allows the user to re-set the valve with minimal flow and will consequently always operate above the flapper chattering zone.

Magnets 502 and 503 may be made of rare earth materials. The various sleeves and housing may be formed of austenitic stainless steels. The portion of the assembly susceptible to erosion, for example, the valve body 520 and lower sleeve 515 could be made of erosion resistant material such as tungsten carbide, ceramic material, hard faced carbon steel, hipped zirconium and stellite.

All of the embodiments may be deployed or retrieved using a wireline or slickline and are easily redressable and repairable. Furthermore, when injection flow is stopped the valve automatically will close, thereby protecting the upper completion from back flow or a blowout condition.

Although the present invention has been described with respect to specific details, it is not intended that such details should be regarded as limitations on the scope of the invention, except to the extent that they are included in the accompanying claims.

What is claimed is:

1. An injection valve comprising:

a) a valve body having an inlet and outlet;

b) a flapper valve element pivotally mounted in a lower portion of the valve body;

c) an axially movable variable orifice insert positioned within the valve body including a second valve, a stationary middle sleeve and an outer sleeve, and a pair of magnets of opposite polarity, one of said magnets being fixed on the middle sleeve and the other of said magnets being movable with the outer sleeve, and a preloaded spring positioned between the movable magnet and the stationary middle sleeve.

2. An injection valve according to claim 1 wherein the variable orifice insert includes an axially movable valve body and a fixed valve seat which together form a variable annular orifice.

3. An injection valve according to claim 2 wherein the axially movable valve body is moved by a pressure differential.

4. An injection valve according to claim 3 wherein the valve seat includes a diverging outlet.

5. An injection valve according to claim 2 wherein the axially movable valve body is secured within a flow passage formed within the variable orifice insert between an inlet and an outlet.

6. An injector valve as claimed in claim 1 wherein the outer sleeve is slideably mounted on the stationary middle sleeve.

7. An injection valve as claimed in claim 6 wherein the variable orifice insert includes a valve seat positioned on an interior surface of the middle sleeve and an annular orifice between the axially movable valve body and the valve seat when the axially movable valve body moves in an axial direction.

8. An injector valve as claimed in claim 1 wherein the variable orifice insert includes an axially movable valve body attached to the outer sleeve.

9. An injection valve as claimed in claim 1 further including an outer sleeve having a J slot, and a pin fixed to the middle sleeve and positioned within the J slot of the outer sleeve.

10. A variable orifice insert comprising:

a) a valve, b) a housing including a stationary middle sleeve, c) an outer sleeve axially movable over the middle sleeve, d) a pair of magnets of opposite polarity, one of said magnets being fixed with respect to the middle sleeve and the other of said magnets being movable with the outer sleeve, and e) a preloaded spring positioned between the movable magnet and the middle sleeve.

11. A variable orifice insert according to claim 10 wherein the outer sleeve includes a lower portion and an axially movable valve body on the lower portion, and a fixed valve seat which together with the axially movable valve body form a variable annular orifice.

12. The variable orifice insert as claimed in claim 11 wherein the fixed valve seat is formed at the downstream end of the middle sleeve.

13. The variable orifice insert of claim 10 wherein the preloaded spring abuts against the movable magnet at one end of the spring and abuts against a shoulder provided on the middle sleeve at a second end of the spring.

* * * * *